United States Patent [19]

Benaroya et al.

[11] Patent Number: 4,491,518

[45] Date of Patent: Jan. 1, 1985

[54] DEVICE FOR SELECTIVELY TAKING UP A LAYER OF LIGHT LIQUID FROM THE SURFACE OF A SHEET OF WATER

[76] Inventors: Henry Benaroya, 41, Bld du Ct Charcot, 92200 Neuilly s/Seine; Jean LeFoll, 14, Av. de l'Europe, 78160 Marly le Roi; Jean-Elie Cadoux, Le Mesnil Hubert en Exmes, 61230 Gace, all of France

[21] Appl. No.: 521,760

[22] PCT Filed: Nov. 23, 1982

[86] PCT No.: PCT/FR82/00198

§ 371 Date: Jul. 25, 1983

§ 102(e) Date: Jul. 25, 1983

[87] PCT Pub. No.: WO83/01799

PCT Pub. Date: May 26, 1983

[30] Foreign Application Priority Data

Nov. 23, 1981 [FR] France ..... 81 21905
Dec. 18, 1981 [FR] France ..... 81 23741

[51] Int. Cl.[3] ..... E02B 15/04

[52] U.S. Cl. ..... 210/177; 210/220; 210/242.2; 210/242.3; 210/512.1; 210/923

[58] Field of Search ..... 210/776, 177, 220, 242.2, 210/242.3, 512.1, 512.3, 923

[56] References Cited

U.S. PATENT DOCUMENTS 3,744,254 7/1973 Fennelly ..... 210/242.3
3,774,767 11/1973 Field ..... 210/923
3,789,988 2/1974 Valibouse ..... 210/242.3
3,823,828 7/1974 Derzhavets ..... 210/242.3
4,126,552 11/1978 Middelbeek ..... 210/242.3
4,136,030 1/1979 Seike ..... 210/242.3
4,139,470 2/1979 Stagemeyer ..... 210/923
4,151,081 4/1979 Bolli ..... 210/923
4,370,229 1/1983 Grihangne ..... 210/242.3
4,391,708 7/1983 LeFoll et al. ..... 210/242.3

FOREIGN PATENT DOCUMENTS 2346502 10/1977 France ..... 210/242.3
2437976 4/1980 France ..... 210/242.3
2467769 4/1981 France ..... 210/242.3

*Primary Examiner*—Ernest G. Therkorn
*Attorney, Agent, or Firm*—Larson and Taylor

[57] ABSTRACT

A device for depolluting a water sheet comprising a hull having a central portion protruding with respect to two side portion which delimit with the central portion delivery pipes to separators. The central portion has a wing for generating swirls of which the orientation reduces the divergence of the surface flow. Each pipe has a floor with a drifting profile with a protruding leading edge for slowing down the flow and for thickening the polluting layer. A vertical partitioning wall separates each pipe into two subchannels of which one communicates downstream with the separator and the other one open, at the rear portion of the device, into a pump.

16 Claims, 21 Drawing Figures

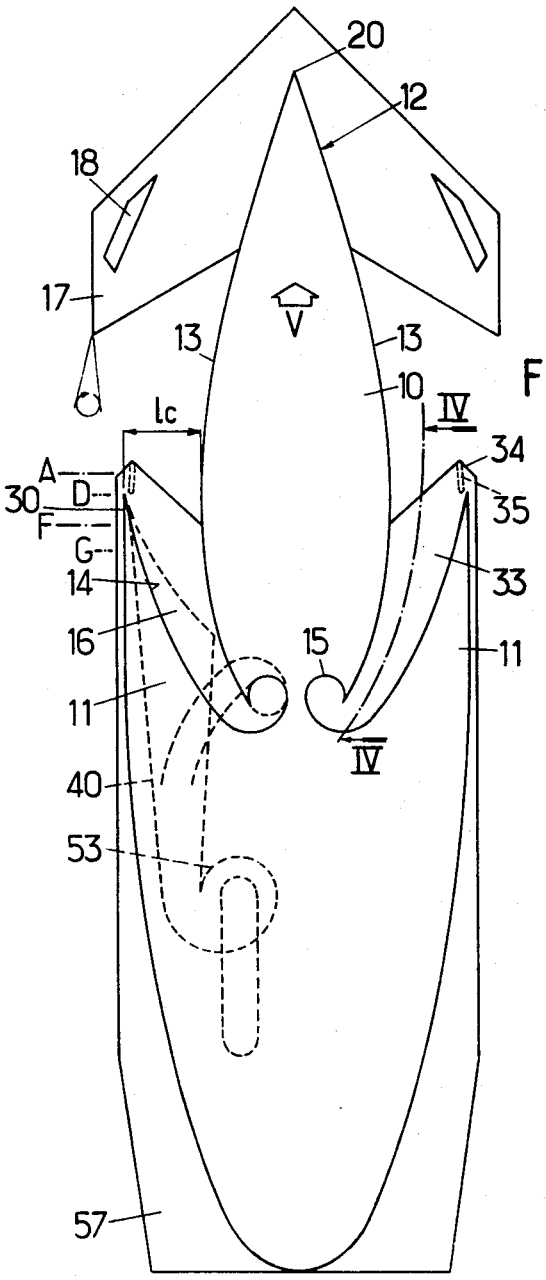
FIG.1.
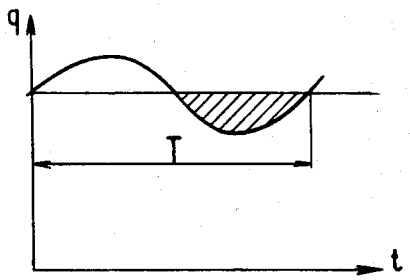
FIG.19.
FIG.13.
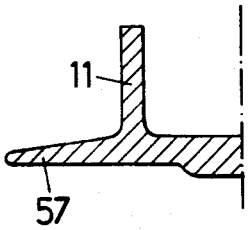

FIG. 17.
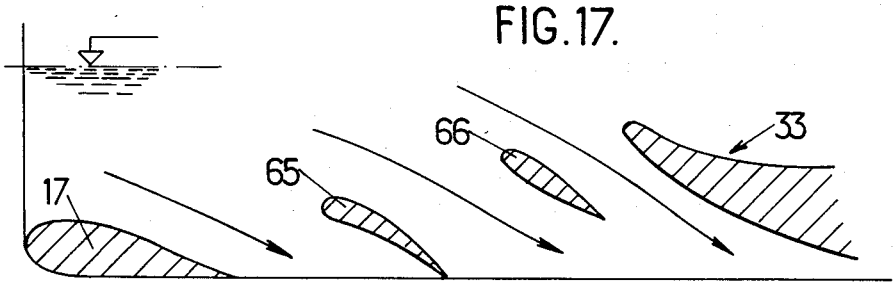
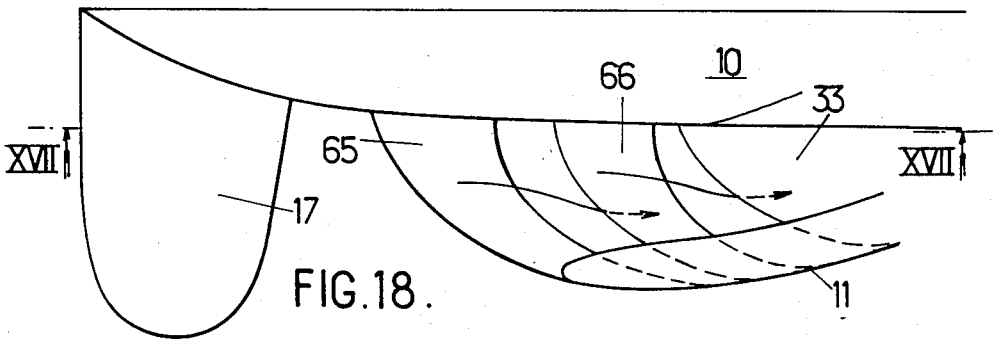
FIG. 18.
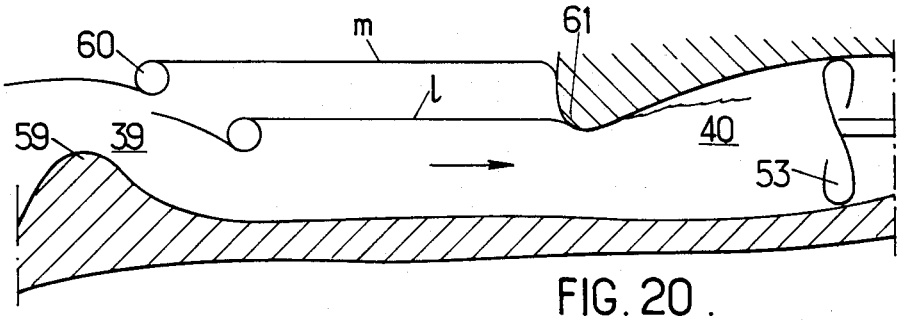
FIG. 20.
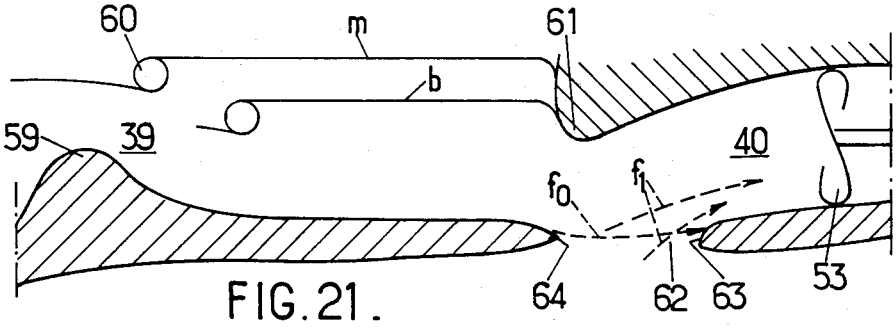
FIG. 21.

DEVICE FOR SELECTIVELY TAKING UP A LAYER OF LIGHT LIQUID FROM THE SURFACE OF A SHEET OF WATER

BACKGROUND AND SUMMARY OF THE INVENTION

The present invention relates to a device or craft for selectively picking up a layer of light liquid, such as hydrocarbon, floating on the surface of a sheet of water likely to be subjected to a swell, usable more especially for cleansing zones covered with a layer of hydrocarbon following accidental discharges.

It should first of all be recalled what the problems are which are met with in the construction of a cleansing or depolluting device for use at sea.

Polluting hydrocarbon is in the form of a thin layer (of the order of a millimeter) formed by a hydrocarbon phase which may be very viscous due to evaporation of the light components or by a polyphase emulsion of hydrocarbon with sea water and/or air, following the stirring caused by the waves.

The device must be designed for cleansing as large a width as possible at each passage. The water inevitably picked up at the same time as the pollutant must represent as small a fraction as possible of the part extracted and stored. To obtain this latter result is thwarted by the very small ratio between the thickness of the pollutant layer and that of the water layer which must necessarily be picked up because of the variations in level due in particular to the swell.

Patent publication No. FR-A-2 467 769 describes a device of a type which comprises a hull provided with propulsion means for running before the sea, the hull having a central part projecting forwardly with respect to the two lateral parts which define with the central part ducts leading to separators and the central part having deflector means such as fins for creating swirls whose orientation tends to reduce the divergence of the surface flow about the hull.

The deflector means allow a double result to be reached. On the one hand, the device thus sweeps the sea between two current lines which, upstream, have a much greater separation than they would have had in the absence of these means; correspondingly, there is a thickening of the light liquid layer at the intake of the delivery ducts. Because the pick-up operation takes place running before the sea, the wake of the ship causes damping of the swell.

Thus, thicknening by a factor of the order of 2.5 may be achieved between the open sea upstream of the device and the water intakes of ducts 16. In practice, because of the convergence of the current lines, a thickening rate of the hydrocarbon layer of the order of 2.5 may be achieved.

Such thickening remains however very insufficient for feeding a separator, more especially of the centrifugal type, under conditions such that the ratio between pollutant and water in the flow picked up is acceptable.

The invention aims more particularly at providing a pick-up device in which progressive thickening of the light liquid layer is achieved along an open stream flow until separation by a free surface swirling procedure, with vertical axis and central pick-up.

This thickening must be carried out very progressively from the stem of the central part as far as the pick-up by an axial plunger tube. In fact, the equilibrium of a light liquid layer of variable thickness causes this liquid to be carried along by the water resulting from a speed discontinuity at the interface with a tangential constraint proportional to the gradient of the square of the thickness; this equilibrium becomes unstable beyond a limit value of this constraint, so also of this gradient or of the speed discontinuity.

To this end, the invention proposes a device of the above-defined type, characterized in that each duct or passage comprises a floor with deviating profile whose leading edge projects forwardly of the ducts, for slowing down the flow upstream of the leading edge and causing progressive thickening of the layer, and in that it is separated by an approximately vertical dividing wall over a part of its height extending at a distance from a horizontal limit of the water layer in two sub-channels one of which communicates upstream with the inlet of the duct and, downstream, with the separator, and the other of which, separated from the first by the dividing wall, opens upstream into means for pumping and discharging to the rear of the device.

The dividing wall is advantageously expanded at its lower part, situated at a distance from the floor, for limiting the curvature of the paths of the liquid which passes from one sub-channel to the other; the total section of the two sub-channels is substantially constant in the flow direction, the section of the first sub-channel being reduced whereas the other increases.

Thus, thickening is achieved by three successive phenomena in a free surface stream:

a free swirling with horizontal axis approximately parallel to the plane of symmetry of the ship, and generated by the deflector means, typically by means of an immersed aerofoil surface connected to the bottom of the central part of the hull and extending forwardly beyond the stem. This swirling superimposes, in the divergent speed zone generated by the central part, speed components converging towards the plane of symmetry at the level of the free surface and causes progressive thickening of the layer by constant speed convergence (rate of thickening of the order of 2.5);

an oblique and approximately horizontal swirl due to the profiled deviating floor forming the bottom of each duct and whose leading edge has a negative camber, at least in the vicinity of the central part of the hull. The swirl induces on the surface speed components which progressively slow down the flow upstream of the leading edge of the floor at the cost of a very moderate divergence. The result is slowing down of the layer, with almost constant width, and a new progressive thickening (rate of the order of 2);

drawing off of the major fraction of the flow picked up in the duct above the leading edge of the floor and which remains completely separate from the flow outside the device until it is finally ejected after passing through a pump, this configuration allowing better control of the progressive drawing off of practically the whole of the flow. For that, practically from the intake of the duct and as far as injection into the swirl of the separator, the duct is separated into two sub-channels by the substantially vertical dividing wall oblique with respect to the median plane of the device, which intersects the floating line and goes down to a short distance from the floor. Since the sum of the areas of the cross sections of the two sub-channels remains substantially constant, that of the discharge (or drawing off) sub-channel increases from 0 to about 9/10 of the total area, whereas that of the supply sub-channel which receives initially the whole flow picked up is correspondingly reduced. Thus, the speed component parallel to the plane of symmetry remains almost constant in the supply sub-channel, both for the water and for the pollutant layer which is progressively thickening (rate of thickening of the order of 10). This arrangement may moreover be reversed, the supply sub-channel being supplied over the dividing wall which forms and overfall.

The floor of the passage is advantageously formed by a thick dividing wall whose sections through vertical planes parallel to the plane of symmetry of the hull are deviating profiles having then a very convex lower face. Usually, the lower face goes down approximately as far as a depth equal to the ship's draft to then rise again towards the rear. The upper face will then have a horizontal sill parallel to the leading edge and immersed at a depth equal approximately to a third of the ship's draft and, rearwardly of this sill, will go down as far as the maximum depth compatible with the thickness required for the mechanical resistance of the floor. The initial increase of the depth of the duct simplifies the problem posed by the loss of effective cross section due to the dividing wall separating the two sub-channels since it compensates for this loss by an increase in the total available cross-section.

At the rear, the vertical dividing wall joins the lateral inner wall of the supply sub-channel.

The leading edge of the dividing wall separates permanently the supply sub-channel, which then plays the role of injection gutter for the open stream swirl of the separator, from the discharge sub-channel which becomes a simple exhaust sub-channel from which the whole flow is drawn off by a pump which may form a means for propelling the device.

The formation in the twin phase flow of breakers or sudden movements must be avoided. This problem is made particularly acute because the device must be designed for working in troubled waters, for example subjected to a swell or a windswept sea. The conditions to be fulfilled, in the case of a permanent flow, for avoiding passing from a torrential flow to a fluvial flow which gives rise to jumps are already known. In the case of periodic working and even when the flow has parts under load where the periodic forces cause periodic compression of the waves, theoretical considerations bring out the conditions to be fulfilled for avoiding breakers in the twin phase flow and the stirring which it causes.

Experience on models has confirmed these considerations which were in no wise evident for a man skilled in the art, used to considering only permanent flows. They lead to providing damping of the swell coming from the rear when running before the sea by a rear immersed fin which provides unexpectedly additional favorable properties. Moreover, it is desirable to interpose, in the discharge sub-channel downstream of the dividing wall in the general flow direction, an immersed overfall which causes locally a torrential flow, fluvial flow transition and the formation of a sudden movement and breakers at a well-defined location where this phenomenon presents no disadvantage and avoids the formation of new breakers further upstream.

In a particular embodiment, the sub-channel of the device which opens into the pumping means presents successively a fraction forming a damping basin, then a part under load opening into the pumping means. The sub-channel has a full wall, so that the pumps can only draw water which has penetrated into the sub-channel by passing over or under the dividing wall.

Since the flow sucked in by the pumping means is substantially constant, or at least varies little, whereas the flow picked up by each supply duct varies periodically, for example because of the swell, the volume of water contained in the basin limited upstream by the dividing wall varies as a function of time. The low level of the free surface in the basin must not drop below a minimum value for which the pumping means would draw in air, which would risk damaging them. This result may be reached by giving the basin large dimensions, as seen from above. But, when the device is provided for operation in swells with a large trough, inacceptable dimensions of the basin, as seen from above, are reached.

To allow operation in conditions such that the flow picked up varies appreciably, without for all that requiring a large-sized damping basin, the sub-channel which opens into the pumping means is advantageously provided with means for supplying it with water from the water layer, for supplying a make-up flow to the pumping means, at least when the level in this channel drops below a given level or exceeds it.

These means for supplying a make-up flow may be limited to an opening communicating with the water layer provided in the wall of the sub-channel, advantageously in the floor. This opening will be generally placed at the inlet of the under load part of the sub-channel which opens into the pumping means or immediately upstream. The input of the part under load may form a downward projecting sill with respect to the downstream portion, so as to better avoid the intake of air towards the pumping means.

The invention will be better understood from reading the following description of particular embodiments given by way of non-limiting examples.

SHORT DESCRIPTION OF THE DRAWINGS

FIG. 1 is a general diagram showing the top view of the device when floating and a possible form of the front fin for creating swirls and of the rear fin for damping the swell;

FIG. 13 is a section, similar to FIGS. 10, showing the trend of the profile of the rear fin;

FIGS. 17 and 18 show schematically another embodiment, respectively in a top view and in section along XVII—XVII;

FIG. 19 is a curve showing the variation of the feed rate of a sub-channel and the suction rate by the pump as a function of time t;

FIG. 20 is a general diagram, in vertical section, showing the variation of the water level in the damping whamber, in the case of an arrangement of the kind shown in FIG. 11;

Figure 2:
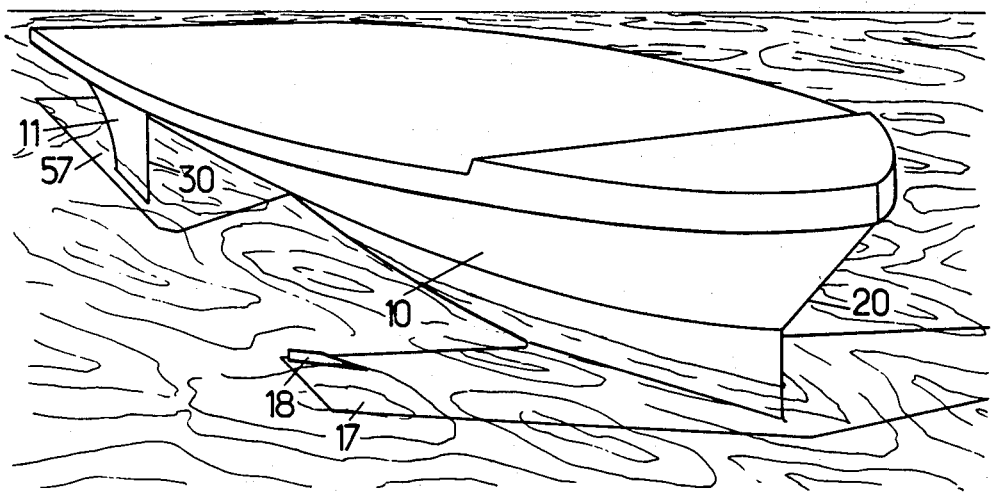
FIG. 2 is a schematical perspective view showing the hull and the fins of the device of FIG. 1.

FIG. 21, similar to FIG. 20, corresponds to one embodiment of the invention.

DETAILED DESCRIPTION OF PREFERRED EMBODIMENTS OF THE INVENTION

Before describing the device, it should be recalled that it forms a ship which moves on the surface of the sea and that the initial movement of the light liquid with respect to this ship is that of a thin layer, of unlimited width on the scale of the ship, driven with a uniform horizontal translational movement, on which is superimposed the movment due to the swell.

If, as is generally the case, the final operation for extracting the light liquid is effected, in a separator using centrifugal forces, by means of a central tube, it is desirable to cause the current lines to bend progressively so as to pass from a uniform translational movement upstream of the device to a movement converging towards the vertical axis of the separators with a radial speed component. The most rational solution for this consists in giving to the current lines of the light liquid a form, which, initially rectilinear, is transformed into a logarithmic spiral in the vicinity of the pick-up tube.

For that, the central part 10 and the lateral parts 11 of the hull 12 have surfaces which delimit the flow along internal spirals 13 and external spirals 14 and join up again at a point of reflection (FIG. 1) 15. These lateral surfaces must extend substantially vertically at least as far as a depth which is chosen as a function of the maximum trough of the swell for which the device is designed. In practice, this verticality is ensured to a depth which is of the order of half the draft D of the device.

The surfaces 13 are thus formed by the wall of the central part 10 of the hull, from the stem which must be designed to limit to the maximum the stem wave which creates turbulences. Each external surface 14 is formed by an inner wall of a lateral part 11, from the stem 30 thereof, which will be generally situated at mid-length of the hull. FIG. 1 shows that a form is thus obtained which, between the stem of the central part 10 and a point approximately at mid-length of the ship, corresponds to the front half of a conventional ship's hull. Between each stem of a lateral part 11 and the stern, the float line corresponds substantially to the rear half of a monohull ship having a midship frame greater than that of the central hull 10.

The overall parameters of shape of the device, and more especially the total length L, the overall width 21 and the pick-up width 21*c*) must be proportioned with respect to each other to provide a satisfactory flow. In practice, the ratio L/21 will remain between about 3.6 and 4. The ratio l/lc will be between 1.5 and 2.5 and a value of the order of 2 is in general satisfactory.

A third important parameter is the ratio D/L of the draft to the length. But the choice of this ratio must take into account different requirements depending on whether it is a question of a device for operating at sea or in the immediate neiborhood of the coast. In the first case, the length L will be generally greater than 75 m and D/L will then be determined by the maximum value which can be given to D for depolluting work, generally less than 12 m; we arrive then at a value less than 0.1, i.e. a very flat device.

On the contrary, devices intended for operation close to the coasts, the most frequent, will have a length less than 75 m and, in this case, a value of D/L between 0.14 and 0.16 may be adopted.

As for the ratio D/1c, also important, it will also be very different depending on whether it is a question of a high seas device, where D/1c $\simeq$0.9, or a coastal device where D/1c $\simeq$2.25.

In all cases, it can be seen that, when the device advances in the direction of arrow V, the water sheet containing a polluting layer may pass round the central part 10 and sweep into the ducts or passages 16 defined by surfaces 13 and 14, whose take-up orifice has generally a width 1c of the order of a quarter of the overall width S1 of the device. It can be immediately seen that the flow penetrating into each duct 16 is enormous. On average, it is a question of a layer of water and pollutant whose thickness will be approximately equal to half the draft D, whose speed is of the order of that of the ship and whose width is about half the width l at midships.

The flow taken up by the plunger tube of the separator must be of two orders of size at least less than this input flow, which leads to striving for a thickening of the light liquid layer before admission to the separators. This thickening will be effected in several steps, under the action of components placed in series and which will be described successively.

Front deflector means: as in the case of the device described in the document No. FR-A-2 467 769, deflector means are provided for causing the surface liquid streams to converge without for all that causing the phenomena of breakers or sudden movements or jumps.

In this case illustrated in FIGS. 1 and 2, these means comprise a front arrow shaped fin 17, having upwardly directed ailerons 18, whose feet converge towards the front and whose role will be explained further on. It is a question here of an arrangement which only differs from that of document No. FR-A-2 467 769 by the presence of the ailerons. The fin 17, with positive lift, creates swirls causing a surface convergence.

This arrangement is not the only one possible; before describing other embodiments, it is preferable to analyze the role of the deflector means and to deduce therefrom the characteristics to be sought and the way of obtaining them.

When the deflector means are formed by a fin, this latter must generate marginal swirls whose efficiency, (measured by the transverse relative movment of the water streams which it causes on the surface) is as high as possible without causing surface breakers, for a given speed of the device. The transverse movement is proportional to the circulation of the swirl created by the fins. It increases with the distance, projected along the longitudinal axis, which separates the stem 30 of the lateral part from the origin of the swirl, as well as with the distance which separates the swirl from the plane of symmetry.

Figure 3:
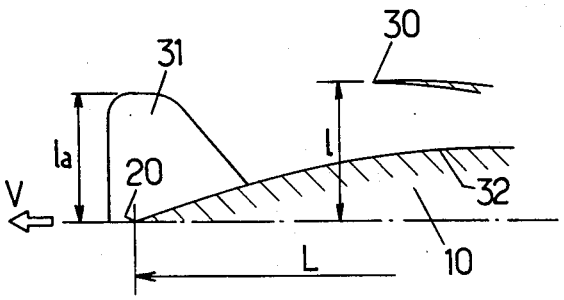
FIGS. 3 and 4 show, respectively in a top view and in elevation, the arrangement of a front fin for creating deflector swirls.

The influence of the depth of the fin is less marked: if the efficiency of a swirl passes through a maximum when the depth of the fin, equal to the draft of the ship, is equal to $i_a/2$ (FIGS. 3 and 4), this maximum is fairly flat.

To increase the distance between the stem of the lateral hull and the origin of the swirl, the fin 31 must be moved forwardly, which leads to placing the leading edge of fin 31 in front of the point where the stem 20 intersects the waterline, so in increasing the overall length of the device. It may be noted that this increase in length only relates however to the waterline 32 of the boat, since the stem may project in the form of a spur above the waterline, as will be seen further on. If it is desired to increase the distance which separates the origin of the swirl from the plane of symmetry, we are practically limited to adopting $l_a=1$, since no sailor will willingly accept that the quick works of the boat occupy a greater lateral space than those of the visible parts of the deck.

The efficiency of marginal swirl, which groups together the whole circulation of a series of free swirls caused by the fin, is equal to the circulation about the profile at its root, itself proportional to the lift of the profile. It is then desirable to increase this lift, but this increase will come up against other requirements which must also be complied with.

Figure 4:
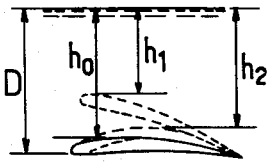

To increase the lift from an initial profile shown with a continuous line in FIG. 4, which leads to a depth $h_0$ of the highest point, the incidence of the fin or its camber may be increased. In both cases, the highest point is situated at a lower depth, $h_1$ or $h_2$. Since the overspeed coefficient also increases with the circulation, the Froude number $F=v:\sqrt{gh}$ (v being the maximum surface speed) increases then for a given speed V of the device when the lift is increased. Now, to avoid surface breaking, the condition $F\leqq 1$ must be respected, which limits the acceptable lift.

Moreover, the above considerations do not take into account the presence of the central part 10 of the hull which causes surface speed disturbances (underspeed in the neiborhood of stem 20, overspeed downstream). It is the resultant of the disturbances due to the fin and of the disturbances due to the hull which is used for defining the value of v not to be exceeded. It is then advantageous to cause, as far as possible, the point where the stem 2I intersects the free surface of the sheet of water to coincide with that where the upper surface of the fin profile passes through the highest point (FIG. 4).

Figure 6:
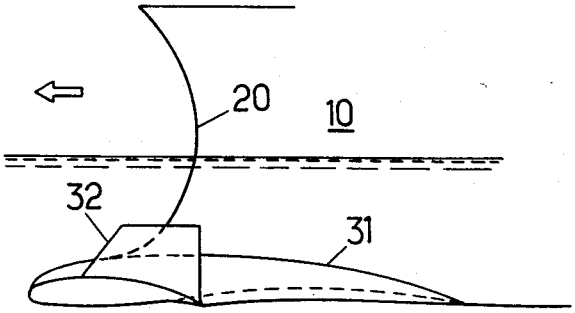
FIGS. 5 and 6 shows, respectively in a top view and in elevation (line VI—VI of FIG. 5) a possible form of fin and aileron for raising the swirl.
Figure 5:
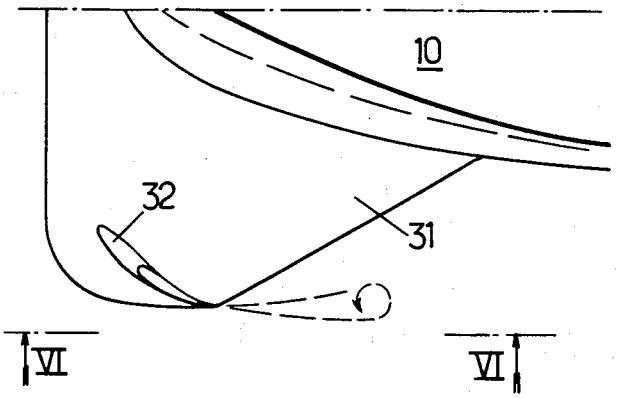

Since, moreover, a robust mechanical connection must be provided between the central part 10 of the hull and fin 31, it is desirable to extend the stem 20 towards the front under the free surface, to form a spur having a bulb for connection with the fin. FIGS. 5 and 6, where the shape of the central part 10 at the level of the free surface is shown in a thick line, whereas the shape at the position of connection with the fin is shown with a fine line and an intermediate level in a dash-dot line, show an arrangement which has proved particularly satisfactory.

However, an isolated fin gives to the swirls a depth of immersion of the marginal swirl which is greater than the optimum value, mentioned above, even in the case of a relatively flat device, for which D/lc is of the order of 0.9 and all the more so in the case of devices with large draft ($D/1_c$ of the order of 2.25).

It is then desirable to raise the level of the swirl.

In the case of a relatively flat device, this result may be reached by providing each fin 31 with a practically vertical aileron 32. To take into account the deflection of the water streams caused on the surface by the central part 10 of the hull, it is desirable to give to the vertical bissecting plane at the trailing edge of the aileron 32 a considerable slope with respect to the mean plane, typically 30° to 35°. This result may be obtained either with a profile of small camber and high incidence, as shown in the case of FIG. 5, or with an average incidence and a high camber.

Figure 7:
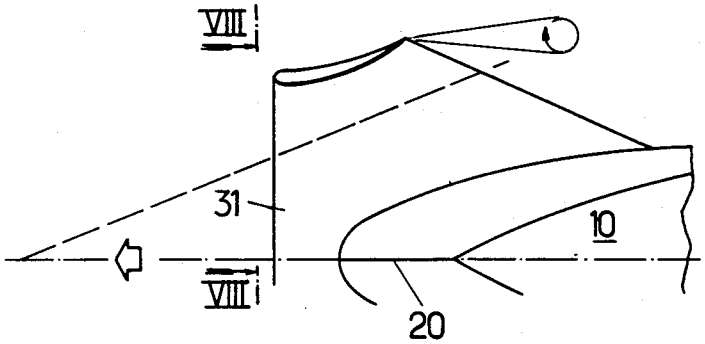
FIGS. 7 and 8 show, respectively in a top view and in direction VIII of FIG. 7, a form of fin forming a variant of that of FIGS. 5 and 6.
Figure 8:
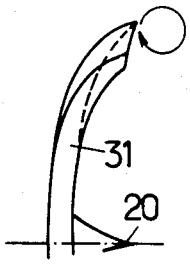

Another solution, shown in FIGS. 7 and 8, consists in giving to the endmost part of fin 31 a "rolled up" form: this latter solution will be generally preferable in the case of devices with considerable draft. Here again, the plane bissecting the endmost part of the fin, presenting a considerable dihedron, must slope considerably with respect to the median plane of the ship (FIGS. 7 and 8).

Slowing down and thickening of the layer at the take-up orifice:

The construction of the pick-up means, at the input of the ducts or passages, poses different problems of which the most important are to avoid the formation of breakers, or sudden movements and the rejection, to the outside of the lateral stems 30, of a fraction of the light liquid.

The risk of breakers appears if the situation is studied immediately upstream of the sill of the pick-up orifice, of width $1_c$, in the presence of level oscillations due for example to the swell. If we designate by $D_c$ the depth of the sill of the duct and by $v_c$ the speed above this sill, the thickness of water above the sill will be on passing through a trough of a swell of amplitude A:

$$h_c=D_c-A.$$

The corresponding Froude number will be $F=v/gh_c$.

This Froude number must not exceed 1, which means that the depth of immersion $D_c$ of the sill in calm water must be:

$$D_c\geqq A+v^2/g.$$

Moreover, $D_c$ must be given the smallest value possible so as to minimize the average flow of water picked up which is equal to $n_c\,D_c\,v$.

The advantage can be seen in obtaining a value of v substantially less than the speed V of the ship, for example of the order of 0.5 to 0.6 V, so in slowing down the flow of the liquid immediately upstream of the sill. But, at the same time, an appreciable local divergence of the polluting layer must be avoided, which would reduce the pick-up width and the thickness of the layer.

In practice, as was pointed out above, it is desirable to give to the sill a depth $D_c$ of the order of a third of the draft D of the ship and this choice is only possible with considerable slowing down.

This slowing down may be obtained by delimiting the open stream on the lower side by a floor 33 having the general shape of a horizontal fin with negative lift. The general trend of the profile, following the broken line of FIG. 1, may then be that shown in FIG. 9. The fin has a spread equal to $l_c$. Its leading edge is at a depth of the order of D/2 if the sill is at a level of D/3. To the rear of a sill, at a depth D/3, the upper face of the fin descends to increase the depth of the duct, then rises again whereas the upper surface dexcends to a depth substantially equal to the draft.

If it is used separately, such a floor shape effectively provides slowing down but creates a marginal swirl which tends to rise inside the stem of the lateral part 11 and cause the overflow of the polluting layer to the outside.

Different solutions may be used for overcoming this disadvantage.

A first palliative consists in extending the floor forwardly behind stem 20 and in giving to its leading edge a shape presenting, at least in the neiborhood of the central part 10, an inverted camber whereas the external part 34 presents an appreciable camber shape, from a point which is slightly on the inside of the stem in the transverse direction.The swirls created by the reverse camber portion cause a convergence of the light liquid layer towards the central part 10, which is favorable. But the swirls due to the other part, as well as the vertical swirl due to the point, tend to cause a divergence.

Figure 9:
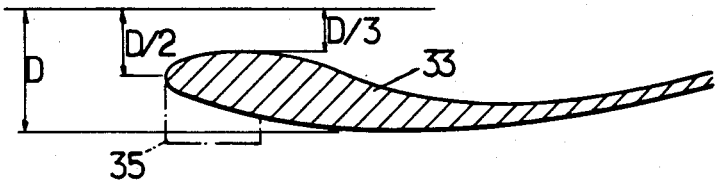
FIG. 9 is a diagram showing the general shape of the floor of a pick-up duct, in section through a vertical surface.

This residual divergence may be compensated for to a large extent by adding to the floor a vertical fin 35 directed downwardly, of the kind shown with a broken line in FIG. 9. If it were isolated, this fin would release a marginal swirl in a direction tending to cause the fluid streams to converge at a depth of the order of D/2, as well as an antagonistic marginal swirl without influence on the surface flow, at depth D. When such a fin 35 is fixed to the floor and if the two profiles are chosen so as to create comparable circulations, the swirl created by fin 35 compensates for the swirl created by part 34 of the floor and, therefore, the vertical swirl at the level of the point disappears.

By way of example, there is shown in FIG. 10A to 10G successive profiles of floor 33. In these figures, the profile of the central part 10 of the hull at the position of the section is indicated with a continuous line whereas the midships is shown with a dash-dot line.

Figure 10A:
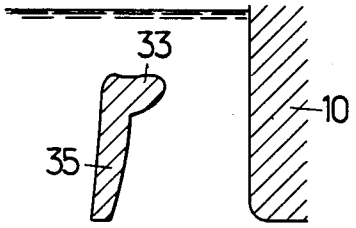
FIGS. 10A to 10G are cross sectional views showing a possible development of the shape of the floor and of the vertical fin situated at the pick-up orifice.
Figure 10B:
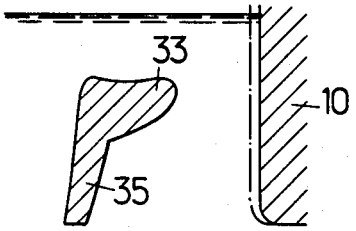
Figure 10C:
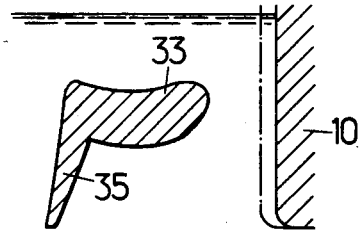
Figure 10D:
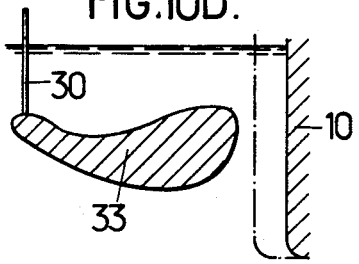
Figure 10E:
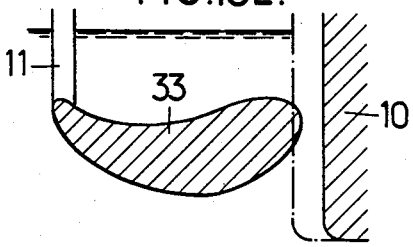
Figure 10F:
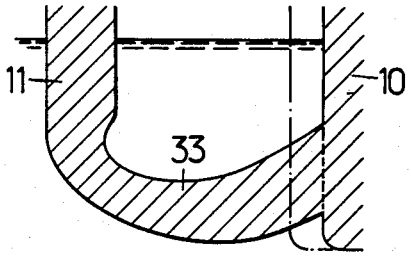

FIG. 10A shows a section through plane A of figure 1, immediately at the rear of the point of the floor. The vertical fin 35 can be seen therein as well as a fragment, of small width, of the floor. FIGS. 10B, 10C and 10D are sections through planes spaced out from that of FIG. 10 to the stem 30 of the lateral part (FIG. 10D). FIG. 10E shows the development of the cross section immediately behind the stem and particularly the thickening of the lateral hull 11. Finally, FIGS. 10F and 10G are sections approximately at the level of planes F and G of FIG. 1.

Figure 10G:
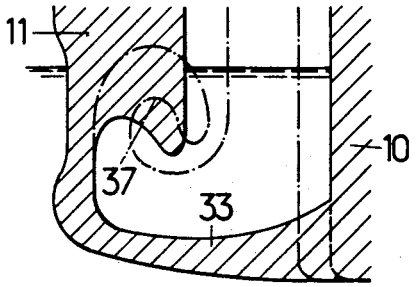

In FIG. 10G, it can be seen that the lateral hull 11 is hollowed out progressively upwardly. This shape corresponds to an embodiment in which the dividing wall between the two sub-channels forms an overfall, a small fraction of the flow taken up overflowing, from the duct, into a subchannel for supplying the separator. There is shown in a dash-dot line in FIG. 10G the general trend of the separating wall 36 to the rear of the section through plane G.

Progressive drawing off:

As has already been mentioned above, it is necessary to direct towards a discharge channel the major part of the water taken up as far as a depth approximately equal to half the draft of the craft. This result may be reached by drawing off below a dividing wall. Providing that the pollutant picked up is not carried along by the downward movement of the water to pass under the dividing wall, the layer of polluting light liquid thickens the nearer to the separator.

The problem to be resolved is then the organization of an open stream flow in the ducts compatible both with the required stability of the water-light liquid interface, even in the presence of a swell, with drawing off of practically the whole of the liquid flow initially picked up in the duct.

To better understand the drawing off mechanism and the role of the different elements which come into play for effecting it, reference will be made to FIG. 11 which shows schematically the arrangement of the transverse dividing wall which separates each duct progressively into two subchannels.

Figures 11, 16:
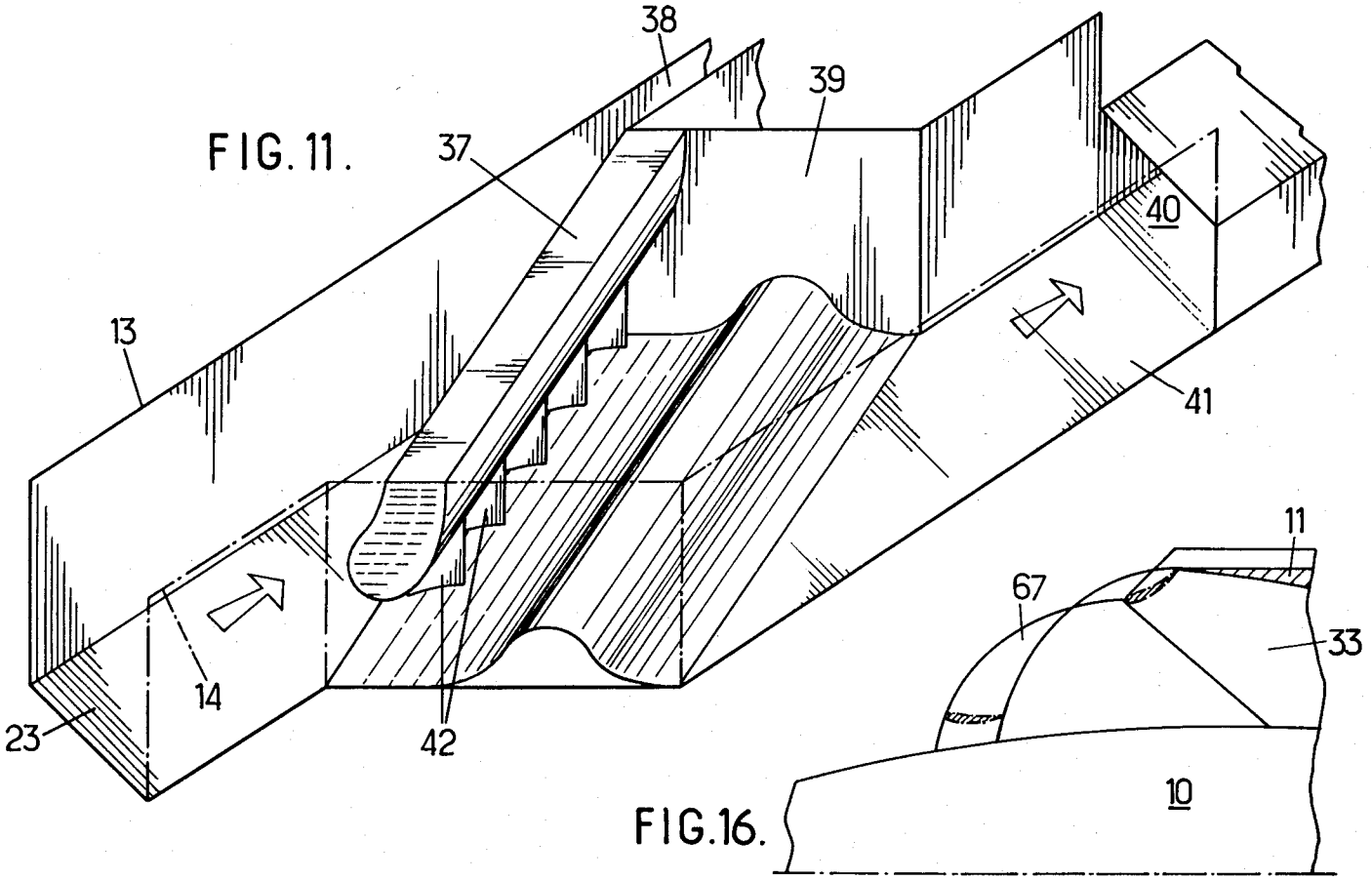
FIG. 11 is a perspective diagram showing the splitting of the duct into two sub-channels by an oblique dividing wall.
FIG. 16 shows a possible construction of an annular fin for further increasing the thickening of the light liquid layer upstream of the ducts.

FIG. 11 shows a supply duct with constant section, which may be likened to the channel defined by surfaces 13 and 14 and floor 23 in FIG. 1. The dividing wall 37 is placed obliquely with respect to the direction of the duct, so as to reduce progressively the passage section offered to a sub-channel 38 which goes towards the separator. This dividing wall terminates, at the top, above the free surface and, below, at a distance from the bottom of the channel. A fraction of the flow is thus progressively drawn off through the bottom into a volume forming a damping basin 39, which is extended by a discharge sub-channel 40 whose external wall 41 is formed by the inner wall of the lateral part of the hull. This external wall of the discharge sub-channel is shown rectilinear in FIG. 11. In practice, it will be obviously shaped to correspond to the shape of the hull.

The flow towards basin 39 involves a change of orientation of the fluid streams. To avoid turbulences, this change of orientation is helped by vanes 42 which, at the same time, support the dividing wall 37. Moreover, the dividing wall is thick so that the change of orientation is progressive. The reduction of the cross-section which results from the presence of the dividing wall is compensated for by the fact that the basin represents an increase of the passage section.

In the approximately triangular basin 37 and the sub-channel 40 which succeeds it downstream, the level of the water may vary. This variation must however remain within a range limited at the bottom end by the risk of air entering the discharge pump and, at the top end, by the presence of a load less than the upstream load. If the pump rotates at constant speed, which will generally be the case, the flow which it takes from the basin 39 diminishes when the level drops, even in the case of a constant section on ejecting. Although this flow variation is not in phase with that of the flow received by basin 39, it contributes to reducing the buffer volume offered by the basin which is necessary. In a variant, the ejection orifice is provided with section adjusting means, for example by means of a flap controlled by an actuating cylinder. In this case, the cylinder may be controlled to modulate the ejection section as a function of the water height in the basin, which allows higher flow variations to be obtained and whose phase is better adapted, and so the minimum buffer volume required in the basin to be reduced.

Centrifugal separator:

The twin phase current supplied by the supply channel, in which the thickness of the light liquid layer is about ten times greater than at the beginning of the duct, is input tangentially into a centrifugal open stream separator. In this separator, the flow in an open supply stream gives rise to two closed stream flows, one formed by a discharge flow passing through the bottom of the separator towards an extraction pump, the other by a take-off flow conveyed by pumping means to storage containers.

Since the light liquid is often an extremely viscous hydrocarbon, it must be heated. This heating is almost impossible to achieve in an open stream. It will then be effected in the closed take-off stream flow which begins at the inlet of a vertical tube plunging into the liquid mass, to a depth at which pollutant is to be permanently found.

Figure 12:
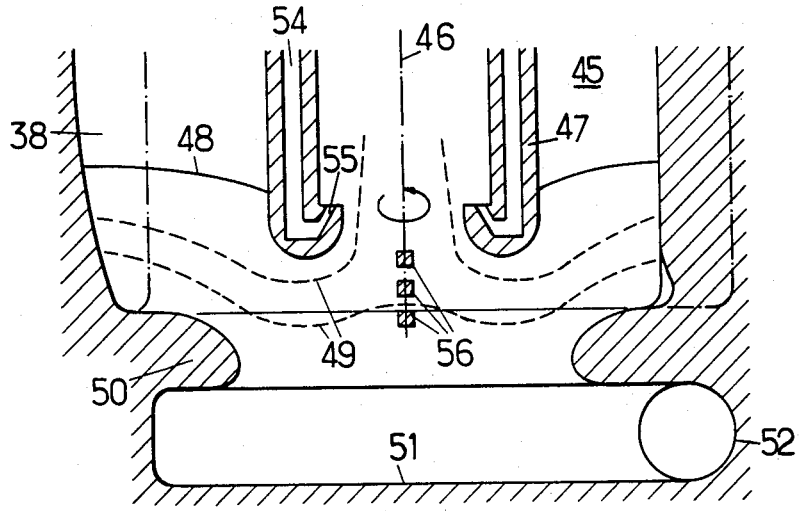
FIG. 12 is a general diagram, in section through a vertical plane, showing the trend of a centrifugal separator with free surface supplied by one of the sub-channels of FIG. 11.

Before describing the particular embodiment of the separator shown schematically in FIG. 12, it should be recalled that the operation of an open stream separator is very different from that of a closed stream separator, where high values of the tangential speed component may be easily obtained which supply a radial acceleration very much greater than the acceleration by gravity. In fact, in an open stream flow, the free surface takes on a slope proportional to the square of the tangential speed, and too high a value of this latter would result in an excessive hollowing of the central region of te liquid mass. Moreover, if the radial and vertical components of the speed are very small (and they will always remain less by an order of size than the tangential component), the interface between the light liquid layer and the water remains substantially parallel to the free surface if the tangential speed remains constant over the whole height of the water mass.

To obtain thickening, means will be provided which give to the tangential speed a decreasing value from the surface towards the bottom, for a constant radius about the axis of the separator.

In the embodiment shown in FIG. 12, this result is obtained by forming the separator by a cavity 45 with vertical axis 46 in which penetrates a plunger tube 47. The supply sub-channel 38 opens tangentially into the upper part of cavity 45 to maintain the rotational movement. The delaying effect of the friction on the central tube 47 gives to the free surface 48 a shape of the kind shown in FIG. 12 and causes thickening of the light liquid layer, as is shown by the shape of the top and bottom borders 49 of the interface in FIG. 12. In practice, the maximum polluting layer thickness which may be reached about tube 47 is only limited by the risk of carrying pollutant downwards by discharge flow.

In practice, a light liquid layer thickness is easily obtained of the order of half the radius of the swirl at the supply orifice, which corresponds, in general, to a thickness of about a hundredth of the overall length of the craft.

The separator shown in FIG. 12, which may be considered as a section through a plane substantially parallel to the median plane of the craft, comprises a thick horizontal dividing plate 50 pierced with an approximately circular cetral hole centered on the axis 46. Plate 50 limits a supply chamber into which emerges the supply sub-channel 38 which maintains the swirling flow and whose wall presents an approximately cylindrical shape whose directrix is a spiral. The discharge chamber placed below plate 50 is defined towards the bottom by a floor 51. It opens through a tangential escape channel 52. The flow in this chamber and the divergent escape channel 52. The flow in this chamber and the divergent escape channel presents a large symmetry with the supply flow. The kinetic moment of the discharged water mass is kept, except for the pressure losses. The corresponding energy may be recovered in a swirl placed downstream or the escape channel 52 may open directly into an extraction pump, which may moreover be formed by the propulsion pump 53 (FIG. 1) which receives the flow from the sub-channel 40. It should be noted that, except in the central region of the swirl, the level of the free stream will exceed that of the floatation because of the conservation of the energy of the flow and the weight of the corresponding volume of water should be taken into account in the longitudinal balance of the craft.

Tube 47 must suck in all the light polluting liquid flow which arrives at the separator, which means that it sucks in at the same time a water flow sufficient for carrying the pollutant even if the viscosity thereof is so high that it is in the form of curds. To avoid the pollutant progressively clogging up the plunger tube 47 by adhering along its inner wall, tube 47 shown in FIG. 12 has a double wall and presents an internal duct 54 for bringing vapor which escapes upwards through a series of holes 55 formed in an internal flange of the tube, at the low part thereof. This injection of vapor heats the pollutant at the same time and makes handling thereof easier. It should be noted in passing that the carrying water drawn in by the plunger tube tends to occupy the central part of the tube and that consequently the injection of vapor at the periphery preferentially heats the pollutant. To prevent the vapor from leaving holes 55 at too high a speed, calibrated input restrictions may be provided in duct 54: the corresponding stratification is adiabatic and does not appreciably modify the heat provided by the vapor.

It can be seen that the polluting light liquid layer is concentrated in the separator to form a nucleus whose thickness and volume correspond to a balance between the flow drawn in by tube 47 and an injected flow which may vary very rapidly, since it is substantially proportional at all times to the thickness of the polluting liquid layer, itself roughly fifty times greater than the average thickness of the polluting layer at right angles to the stem 20. This nucleus forms a buffer volume. It is normally kept between definite limits by controlling the pump (not shown) for sucking in the light liquid by a relay actuated by means determining the level of the interface, indicated schematically at 56. These means may be formed more especially by an electric cell or a float whose average density is between that of water and that of the light liquid, connected to a relay controlling the motor of the pump.

The whole of the polluting light liquid must be drawn in through tube 47. To fulfill this condition without fail, whereas the flow of this liquid is subjected to variations which are impossible to measure, a proportion of water must be admitted into the flow sucked up, which as a general rule will be less than two thirds. This proportion is sufficiently small for the residual water to be eliminated by a conventional centrifugal separator (not shown) operating with a closed stream, placed between tube 47 and the suction pump.

The light liquid finally obtained will be stored. This storage may be provided in tanks place on board the depolluting craft, from where the pollutant will be subsequently transferred to land-based reservoirs. However, in the case of small-sized craft, the pollutant may be stored in containers which are closed and weighted. These containers are then immersed progressively as they are filled at positions marked by buoys. The containers are then recovered by non specialized ships.

It should be noted that the buffer volume represented by the nucleus will be generally sufficient to allow the suction pump to be momentarily stopped for the time required for changing the container for storing the polluting light liquid.

Up to now, it has been essentially a question of means for thickening the thickness of the polluting layer, then extracting it at the same time as an amount of water as small as possible. It is a question here of means whose role is essential in calm water. But, under the conditions of operation at sea, breakers and the formation of jumps must in addition be avoided at positions where they risk causing stirring harmful to the separation, in particular in the ducts and at the intake thereof forming the pick-up orifice.

A first remedy consists in reducing the amplitude of the swell coming from the rear in when running before the sea, during its travel along the hull before it reaches the pick-up orifices. In the embodiment shown in FIGS. 1, 2 and 3, the craft comprises a rear fin 57. It is preferable for this fin not to project rearwards from the craft. The thickness of fin 57 increases from the rear to the front and the fin is placed at a depth slightly less than the draft of the craft. When running before the swell, especially in craft of great length, fin 57 damps the absolute movement of the swell in a penumbra zone which covers the whole free stream flow before entering the pick-up orifices of the ducts.

Moreover, on craft of great length, the fin reduces the pitching amplitude. On craft of small length, it damps the relative movement of the ship with respect to the sea, especially if it has a positive lift. The fin plays finally a role of anti-roll keel.

A second remedy takes into account the fact that the most dangerous disturbances from the point of view of the risk of breakers are those which raise the general flow. Such disturbances may appear in the ducts following the reflection of the waves which pass down the duct, then the escape sub-channel towards the under load part thereof.

This result may more especially be reached because of a geometry of the discharge sub-channel which leads to localized breakers behind the dividing wall 37 (in the direction of the general flow) and in the immediate vicinity of this dividing wall and on an appropriate control of the propulsion pump, so as to maintain in basin 39 a head of water sufficiently low to ensure torrential flow.

Figure 14:
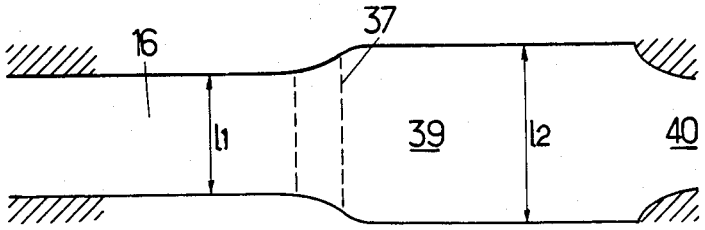
FIGS. 14 and 15 are general diagrams, respectively in a top view and in elevation, showing one construction of the second sub-channel for avoiding breakers in the duct.
Figure 15:
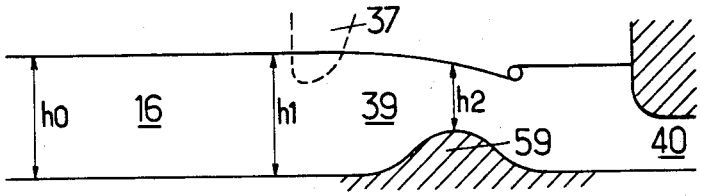

The conditions to be established will better appear if we analyze the discharge flow towards the sub-channel 40 on a simplified diagram of duct 16, basin 39 and sub-channel 40, which comes under pressure downstream of the basin. FIGS. 14 and 15 show these components of the installation schematically in alignment to facilitate the analysis.

The pump sucking up the flow which flows through sub-channel 40 is controlled so that this sub-channel remains under pressure and so that there is no air admitted into the pump and also so as to maintain immediately upstream a speed and water head such that the flow is of the fluvial type, i.e. with a Froude number less than 1. Basin 39 is given a width $l_1$ greater than the width $l_1$ of the duct and a sunken overfall 59 is placed therein which reduces the depth and, correspondingly, causes a local increase of the speed. The widening $l_2/l_1$ and the height of the overfall 59 are chosen so that the variations undergone by the flow from upstream to downstream are the following.

In duct 16, upstream of dividing wall 37, the flow speed and the depth $h_1$ are such that the flow is fluvial (Froude number less than 1). In the upstream part of the basin, this fluvial character is further enhanced because of the reduction of the speed caused by the increase in width. On the other hand, the depth $h_2$ of the flow at right angles to the overfall becomes such that the Froude number becomes equal to, then greater than 1. It is maintained greater than 1, then the flow becomes fluvial again with formation of a jump 60 which is likely to move longitudinally within a limited range. The disturbances occurring from upstream to downstream pass through the jump and may be reflected at the intake of the under load sub-channel 40. But the reflected disturbances cannot pass the jump and disturb the flow in the duct.

The invention is not limited to the particular embodiments given by way of examples but, on the contrary, is susceptible of numerous variations. It may in particular be noted that means other than the vertical fins 35 shown in FIGS. 1 and 10 may be used. FIG. 16 shows by way of example a fin 67 annular in shape adapted to be used at the front of floor 33. This fin is connected to the floor 33 by a profile which may be similar to that shown in FIG. 10G then the fin comes back towards the front to be connected to the central part 10 of the hull by a profile close to the horizontal, as shown by a turned down section shown with a dash-dot line. At its root on floor 33, the fin has however a smaller length than in the case of FIG. 10 and a higher incidence, so that fin 61 does not descend below the draft of the hull.

This arrangement provides a double advantage. The annular fin, embedded at both its ends, has a rigidity and a strength greater than a cantilevered fin; the free swirls are suppressed which escape from a fin of the kind shown in FIGS. 1 and 10, which swirls may in some cases be troublesome, although they are released at considerable depth.

The floor 33 of the embodiment shown in FIGS. 1, 2 and 9 is solid. Despite the slowing down of the flow provided upstream of the catchment area it limits the speed at which the craft may move, since it is necessary to avoid an overflow. In the variant shown in FIGS. 17 and 18, this limitation is removed to a large extent by effecting the catchment (i.e. the separation between the polluted flow picked up and the water returned to the ambient medium) in two steps. First of all the stream of liquid picked up is closed laterally by the lateral hull 1, placed obliquely and then the stream is closed by the floor 33 downstream of the stern of the lateral hull. In its upstream part, floor 33 is limited to sloping vanes 65 and 66 connecting together the two hulls and of a progressively decreasing depth (FIG. 17). The purpose of these vanes is to eject from the bottom to the outside, under the lateral hull 11, the lower part of the water flow of the stream, which part does not contain any pollutant. The front part of the lateral hull will in this case have a depth between a half and a third of the draft of the craft. The non rejected part of the stream is directed towards the pumps.

The continuous line curve shown i FIG. 19 shows the variation of the supply flow supplied to a sub-channel opening into pumping means as a function of time, in the presence of a swell of period T. This supply flow empties into a damping basin 39 (FIG. 20) communicating with the pumping means 53 through a duct 40 under pressure. The pumping means 53 are provided so as to suck up an approximately constant flow (broken line in FIG. 19) which corresponds to the mean supply flow. The level of the water mass contained in the basin varies then as a function of time, the difference between the average volume and the minimum volume of water in the basin being shown by the hatched surface in FIG. 19. To each value of this difference in volume there corresponds a difference between the mean level m of water in the basin (downstream of the jump 60 due particularly to the presence of the sunken overfall 59) and the low level. This difference is all the greater the smaller the area, seen from the top, of the basin 39.

Sucking in of air by the pumping means 53 must be avoided, which means that the low level should be prevented from dropping below a limit 1 beyond which the tunnel 40 is no longer under pressure. It should be noted that any air sucked in by the pump amplifies the phenomenon for the ejection channel in which the pump is placed is then partially emptied of the water which is contains, which tends to raise the rear of the craft and, especially, the sill of the overfall 59, resulting in an additional reduction of the supply flow.

The risk of depriving the pumping means 53 of water is avoided by providing the sub-channel with means for supplying water from the water in which the craft is travelling. In the embodiment shown in FIG. 21, the means for supplying the sub-channel with make-up water are formed by an opening 62 formed in the floor to provide a permanent communication between the sub-channel and the sea. The opening shown is placed in the front part of the under pressure tunnel 40. The roof of this front part has a downwardly projecting sill 61, for further reducing the risk of sucking in air. For the mean level m, the flow of the water streams at the bottom takes place along the floor upstream and downstream of the opening 62 (arrow $f_0$). When the level drops because of a reduction of the supply flow, water is sucked up from the ambient water medium (arrow $f_1$). Thus, for the flow which corresponds to the limit 1 in the case of FIG. 20, a low level b may be maintained in basin 39 to avoid sucking in any air.

The optimum dimensions to be given to opening 62 may be easily determined experimentally. As a general rule, this opening will be either at the inlet of the under pressure part 40, or immediately upstream, partly under sill 61. When the level of the water in the damping tank 39 is greater than the mean level, water is ejected through opening 62: this ejection is without risk since this water flow is free of pollutant. According to the relative position in height and in angle of incidence of the leading edge 63 downstream of opening 62 and of the trailing edge 64 upstream, a mean value in time may be given to the make-up flow towards the pumping means 53 which is positive, zero or even negative, when the craft is moving at its normal operating speed, the make-up flow being always positive in the case of a zero speed. If for example the opening 62 is provided to supply an average make-up flow of the order of 10 to 20% of the total flow sucked in by the pumping means 53, a maximum flowrate may be obtained of the order of 50% of the flow sucked in by the pump, which clearly shows a very high influence on the maintenance of the level in the damping basin 39 at a sufficient height.

The intake opening for a make-up flow may be provided with swinging flaps avoiding the ejection of a fraction of the flow which has passed the sunken overfall. These flaps may be provided with actuating cylinders which hold them closed when the craft is moving without operating for picking up a layer of light liquid, for example when travelling towards an operating site.

We claim:

1. Device for removing floating liquid pollutants from a body of water, comprising: a hull provided with means for moving it in a predetermined direction through the body of water and having two lateral parts, and a vertical central part, placed between the lateral parts, projecting forwards with respect to the latter in said predetermined direction and bearing an immersed deflector fin part at least of which is located forward of the lateral parts, said fin being shaped for creating swirls in the water body whose orientation tends to diminish the divergence of the flow lines in the vicinity of free water level ahead of said lateral parts due to movement of the device, said lateral parts and central part cooperating to define ducts directing a flow of water and pollutant taken close to the water level to separator means in said hull wherein each of said ducts comprises a floor with deviating profile whose leading edge projects upstream of the intake orifice of the duct, which floor is shaped to slow down the flow upstream of the leading edge and to cause a progressive thickening of the light liquid layer and wherein an approximately vertical dividing wall terminating at a distance from the wave which flows through the duct separates the duct, over a fraction of its height, into two sub-channels one of which communicates downstream with said separator means and the other of which opens downstream into pumping means pumping water out of the rearwardly part of said device to cause a propulsive effect.

2. Device according to claim 1, wherein the dividing wall (37) terminates at a distance from the floor and is expanded in its low part to limit the curvature of the liquid streams which pass from the duct and from the first sub-channel (38) to the second sub-channel (40), the total section of the two sub-channels being substantially constant along the flow and the section of the sub-channel going towards the separator decreasing whereas the other one increases.

3. Device according to claim 1, wherein the floor is in the form of a fin whose leading edge has a negative camber in the vicinity of the central part of the hull.

4. Device according to claim 3, wherein the outermost fraction (34) of the leading edge of the floor presents a positive camber at right-angles to the stem (30) of the lateral part (11) of the hull (12) and in that the floor carries, in the vicinity of the leading edge, an approximately vertical fin (35) for compensating the surface divergence effects due to the leading edge of the floor.

5. Device according to claim 2, wherein the floor has a profile with a downwardly directed camber, whose under surface has a sill at a depth essentially equal to half the draft of the device, then deepening to the maximum distance compatible with the mechanical strength of the floor.

6. Device according to claim 1, wherein the deflector fin are formed by a fin with positive lift whose leading edge is situated in front of the point where the stem (20) of the central part (10) of the hull intersects the waterline, the spread of the fin being substantially equal to the overall width of the hull.

7. Device according to claim 6, wherein the fin (17) is at a depth of the same order as the draft of the hull so as to avoid breakers and in that the fin carries substantially vertical ailerons presenting considerable forward convergence projecting upwards from the fin in the vicinity of the ends thereof to raise the swirls.

8. Device according to claim 1, wherein the fin has a depth of the same order as the draft of the hull at the root and a rolled up part for presenting a dihedron progressively increasing towards its ends.

9. Device according to claim 1, wherein the stem (20) of the central part (10) forms, below the waterline, a bulb spur connected to the fin.

10. Device according to claim 1, wherein the sub-channel which opens into the pumping means comprises a sunken overfall for causing the disturbances to break which travel up the flow.

11. Device according to claim 1, wherein it comprises a rear fin immersed at a depth of the same order as the draft of the hull, for weakening the swell when running before the sea and for reducing the disturbances at the inlet of the ducts.

12. Device according to claim 1, wherein the separator means comprises a cavity (45) with vertical axis (46) separated by a horizontal plate (50) pierced with a central hole into a supply chamber into which opens the sub-channel (38) and a discharge chamber opening into a tangential escape channel (52), the separator further comprising a central tube (47) plunging into the top part of the swirling flow with free surface in the supply chamber and communicating with a light liquid suction pump.

13. Device according to claim 12, wherein the tube (47) has a double wall and has an internal duct (54) for supplying vapor which escapes upwards through holes formed in an internal flange of the tube at the low part thereof.

14. Device according to claim 1, wherein the sub-channel which opens into the pumping means is provided with means for supplying water from the water medium provided for supplying a make-up flow to the pumping means at least when the level in this channel drops to a given height and exceeds it.

15. Device according to claim 14, wherein the means for supplying a make-up flow are formed by an opening (62) formed in the wall of the sub-channel.

16. Device according to claim 1, wherein the floor (33) is formed in its front part by vanes (65, 66) each connecting the central part (10) to one of the lateral parts (11) and in that each lateral part is extended forwards into said front part and presents, in its part connected to the vanes, a depth between a third and a half of the draft of the device.

* * * * *